United States Patent [19]

Tutihasi et al.

[11] 3,950,167

[45] Apr. 13, 1976

[54] IMAGING SYSTEM

[75] Inventors: Simpei Tutihasi, Pittsford; William L. Goffe, Webster, both of N.Y.

[73] Assignee: Xerox Corporation, Stamford, Conn.

[22] Filed: Sept. 26, 1973

[21] Appl. No.: 401,092

[52] U.S. Cl. ..... 96/1 R
[51] Int. Cl.[2] ..... G03G 5/04
[58] Field of Search ..... 96/1 R, 1 M, 1.5

[56] References Cited

UNITED STATES PATENTS

| | | | |
|---|---|---|---|
| 3,121,006 | 2/1964 | Middleton et al. | 96/1.5 |
| 3,573,904 | 4/1971 | Clark | 96/1 M |
| 3,598,644 | 8/1971 | Goffe et al. | 96/1.5 |
| 3,794,539 | 2/1974 | Komiya et al. | 96/1 R |
| 3,797,928 | 3/1974 | Kinoshita et al. | 96/1 R |

*Primary Examiner*—David Klein
*Assistant Examiner*—John L. Goodrow
*Attorney, Agent, or Firm*—James J. Ralabate; John B. Mitchell; William A. Marvin

[57] ABSTRACT

A system for "capturing" charge within the structure of an electrophotographic imaging member in the imagewise exposed areas and thereby creating an electrostatic latent image in the imagewise exposed areas which in preferred embodiments of discrete non-touching particles of electrically photosensitive material stands up better against time, heat and light. Said imaging member is comprised of an insulating layer and electrically porous, mechanically discontinuous electrically photosensitive layer contacting said insulating layer. The process includes (1) charging, (2) imagewise exposure, and (3) promoting the dissipation of charge from the areas which are relatively non-exposed compared to the exposed areas, leaving behind an electrostatic latent image in the imagewise exposed areas. The electrostatic image thus created may be used or developed by any suitable technique other than by causing imagewise migration of said electrically photosensitive material.

11 Claims, 10 Drawing Figures

IMAGING SYSTEM

BACKGROUND OF THE INVENTION

This invention relates in general to imaging, and more specifically to the creation of an electrostatic latent image in the imagewise exposed areas of an electrophotographic imaging member, which in preferred embodiments stands up against time, heat and light.

Recently, a process for stabilizing, or setting, migration imaging electrical latent images has been developed. Such stabilizing processes are disclosed in copending applications Ser. Nos. 349,585; 349,506 and 349,505, all three filed on Apr. 9, 1973. Typically, the process of setting said electrical latent images comprises providing a migration imaging member, electrially latently imaging the migration layer and setting the electrical latent image by either storing the migration layer in the dark or applying heat, applying vapor, or applying partial solvents in a predevelopment softening step. After setting of the electrical latent image, the migration layer can be exposed to activating electromagnetic radiation without loss of the latent image. Also long delays of up to years are possible, between formation of the electrical latent image and the development step which allows selective migration of migration material in depth in a softenable material.

The above-mentioned three stabilizing process applications are based mainly upon a recently developed migration imaging system capable of producing high quality images of high density, continuous tone, and high resolution. Such migration imaging systems are disclosed in copending applications Ser. No. 837,780, and Ser. No. 837,591, both filed on June 30, 1969. In a typical embodiment of the migration imaging system, an imaging member comprising a substrate with a migration layer comprising a layer of softenable material and electrically photosensitive migration material is imaged by forming an electrical latent image on the member, for example by electrically charging the member and exposing it to a pattern of activating electromagnetic radiation such as light. When the photosensitive migration material is layered on or in, but spaced apart from, one surface of the softenable material layer (layer configuration), migration material from the migration layer migrates imagewise toward the substrate when the member is developed by decreasing the resistance to migration of migration material in depth in the softenable layer.

One mode of development entails exposing the member to a solvent which dissolves only the softenable layer. The photosensitive migration material (typically particles) which has been exposed to radiation migrates through the softenable layer as it is softened and dissolved, leaving an image of migrated particles corresponding to the radiation pattern of an original on the substrate with the material of the softenable layer substantially washed away. The particle image may then be fixed to the substrate. For many preferred photosensitive migration particles, the image produced by the above process is a negative of a positive original, i.e., particles deposit in image configuration corresponding to the radiation exposed areas. Those portions of the photosensitive material which did not migrate to the substrate are washed away by the solvent with the softenable material layer. However, positive to positive systems are also possible by varying imaging parameters. As disclosed in the referenced applications, by other developing techniques, the softenable material layer may at least partially remain behind on the supporting substrate with or without a relatively unmigrated pattern of migration material complementary to said migrated material.

It is also known that the imaging members in layer configuration similar to those used herein, can be used as photoreceptors in xerography where the electrostatic image is formed in the relatively unexposed areas. This use is disclosed in U.S. Pat. Nos. 3,573,906 and 3,723,110. While there are known methods for developing the relatively exposed areas of xerographic plate, they typically entail the use of special reversal developer or toner, development electrodes, etc. Now it has been found that a similar photoreceptor may give, in the process of the invention hereof, in a charge, expose process an electrostatic latent image in the imagewise exposed areas which may be developed e.g. by direct xerographic techniques.

SUMMARY OF THE INVENTION

It is, therefore, an object of this invention to provide a new imaging system for creation of electrostatic latent images which stand up against time, heat and light.

It is another object of this invention to provide an imaging system for providing an electrostatic latent image in light struck areas of an electrophotographic imaging member.

It is another object of this invention to provide an imaging system for creating an electrostatic latent image which, when developed, displays high resolution, high density and continuous tone.

It is a further object of this invention to provide an imaging system for creating an electrostatic latent image which may be developed by standard techniques, especially xerographic.

It is a still further object of this invention to provide imaging members which can have electrostatic latent images created therein to be used as xerographic masters.

It is an even further object of this invention to provide an imaging system wherein the electrostatic latent image of this invention may be erased.

The foregoing objects and others are accomplished in accordance with this invention by providing an imaging system for "capturing" charge within the structure of an electrophotographic imaging member in the imagewise exposed areas and thereby creating an electrostatic latent image in the imagewise exposed areas which in preferred embodiments of discrete non-touching particles of electrically photosensitive material stands up better against time, heat and light. Said imaging member is comprised of an insulating layer and an electrically porous, mechanically discontinuous electrically photosensitive layer contacting said insulating layer. The process includes (1) charging, (2) imagewise exposure, and (3) promoting the dissipation of charge from the areas which are relatively non-exposed compared to the exposed areas, leaving behind an electrostatic latent image in the imagewise exposed areas. The electrostatic image thus created may be used or developed by any suitable technique other than by causing imagewise migration of said electrically photosensitive material.

BRIEF DESCRIPTION OF THE DRAWINGS

The advantages of this invention will become apparent upon consideration of the following detailed disclosure of the invention, especially when it is taken in conjunction with the accompanying drawings wherein.

DESCRIPTION OF THE PREFERRED EMBODIMENTS

Figure 1:
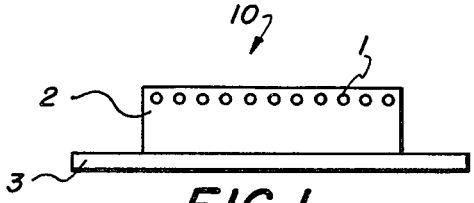
FIG. 1 is a partially schematic view of an imaging member similar to a layered configuration migration imaging member but suitable herein instead of migration of the electrically photosensitive layer, for having electrostatic latent images formed thereon and developed according to the process of the instant invention.

In the following description, reference will be made to the numerals in the drawings, wherein like numbers represent like materials and elements.

Referring now to FIG. 1, there is shown an imaging member 10 comprising a thin, electrically porous, electrically photosensitive layer 1 embedded at the surface of an insulating layer 2, supported on a conductive base 3.

The substrate 3 is preferably conductive, but can be an insulating material or a combination of both such as a thin conductive layer over an insulating layer. The substrate may be mechanically rigid or flexible, transparent or opaque depending upon the needs of the particular imaging system. Typically, this member is a metal, such as aluminum, brass, copper, chromium, stainless steel, zinc, but may be a conductive rubber, paper or plastic. A combination member may be used comprising a conductor coated on an insulator such as plastic, paper or glass.

Furthermore, the substrate and the entire imaging member which it supports may be in any suitable form including a web, foil, laminate or like, strip, sheet, coil, cylinder, drum, endless belt, endless moebius strip, circular disk or other shape. Alternatively, the insulating layer 2 may be self-supporting and may be brought into contact if desired, with a suitable substrate during imaging.

Figure 2A:
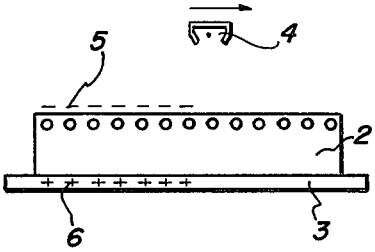
FIGS. 2*a*, 2*b* and 2*c* are partial schematic views of an imaging member showing the various process steps of the instant invention.
Figure 2B:
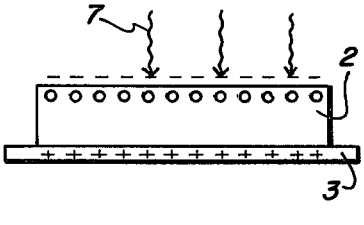
Figure 2C:
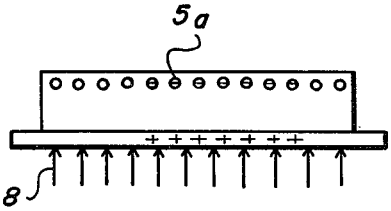

The basic process steps for forming an electrostatic image with this structure is shown in FIGS. 2*a*, 2*b* and 2*c*. FIG. 2*a* shows the charging step, in this instance a corona discharge device 4 for placing a negative charge 5 at the surface of the imaging member and inducing an opposite and equal charge 6 on the base layer. FIG. 2*b* shows the exposure step, in this case an imagewise exposure to light. FIG. 2*c* shows a processing step which promotes the injection of surface charge into the structure of the imaging member and either selectively captures or transports that charge through the insulating layer to the base. As a result of these process steps, an electrostatic image is formed comprising charge in/on the photoconductive layer at 5 a in the previously light exposed areas.

The term "electrically porous" as used herein with regard to the electrically photosensitive layer, means a mechanically discontinuous layer, or, more specifically, an electrically photosensitive layer which is not mechanically continuous. Thus, the electrically photosensitive layer may comprise a near monolayer of discrete particles, a screened photoconductor layer, or discontinuous layer having a multitude of random open spaces (such as a Swiss cheese or screen configuration), holes, threads or cracks. Electrical porosity means that the layers will discharge in the dark. This is accomplished by providing mechanically discontinuous photosensitive layers.

While photoconductive materials (and "photoconductive" is used in its broadest sense to mean materials which show increased electrical conductivity when illuminated with electromagnetic radiation and not necessarily those which have been found to be useful in xerography in a xerographic plate configuration) have been found to a be class of materials useful as "electrically photosensitive" materials in this invention, and while the photoconductive effect is often sufficient in the present invention to provide an "electrically photosensitive" material, it does not appear to be a necessary effect. Apparently the necessary effect is the selective relocation of charge into, within, or out of the material; said relocation being effected by light action on the bulk or the surface of the electrically photosensitive material, by exposing said material to activating radiation; which may specifically include photoconductive effects, photoinjection, photoemission, photochemical effects and others which cause said selective relocation of charge and which cause final capture of charge to form the electrostatic image upon suitable accessibility to the surface charge. Also, preferred as electrically photosensitive materials herein are materials which do not require relatively large amounts of charge if not exposed.

The electrically porous layer 1 may comprise any suitable inorganic or organic photosensitive material. Typical inorganic materials are vitreous selenium, vitreous selenium alloyed with arsenic, tellurium, antimony or bismuth, etc.; cadmium sulfide, zinc oxide, cadmium sulfoselenide, and many others. U.S. Pat. No. 3,121,066 to Middleton et al and U.S. Pat. No. 3,288,603 set forth a host of typical inorganic pigments and suitable binders therefor which are hereby expressly incorporated herein by reference. Typical organic materials are: Watchung Red B, a barium salt of 1-(4′-methyl-5′-chloro-azo-benzene-2′-sulfonic acid)-2-hydrohydroxy-3-naphthoic acid, C. I. No. 15865, available from DuPont; Indofast double scarlet toner, a Pyranthrone-type pigment available from Harmon Colors; quindo magenta RV-6803, a quinacridone, such as Monastral Red B (E.I. DuPont), Cyan Blue, GTNF the beta form of copper phthalocyanine, C. I. No. 74160, available from Collway Colors; Monolite Fast Blue GS, the alpha form of metal-free phthalocyanine, C. I. No. 74100, available from Arnold Hoffman Co.; Diane Blue, 3,3-methoxy-4,4′-diphenyl-bis(1″azo-2″ hydroxy-3″-naphthanilide), C. I. No. 21180, available from Harmon Colors; and Algol G.C., polyvinyl carbazole 1,2,5,6-di(D,D′-diphenyl)-thiazole-anthraquinone, C. I. No. 67300, available from General Dyestuffs. The above list of organic and inorganic photosensitive materials is illustrative of some of the typical materials, and should not be taken as a complete listing.

The thickness of the electrically porous layer is preferably in the range between about 0.1 and about 2 microns; however, layers in the range between about 0.01 and about 20 microns are satisfactory.

Insulating layers in the range between about 1 and about 20 microns are preferred, however layers in the range between about 0.1 and about 200 microns are satisfactory.

While thicker and thinner films will work, thinner films require greater exposures and thicker films give lower resolutions. Thicker photosensitive layers require thicker insulating layers to avoid an opposing discharging effect which drops the potential substantially below the original potential applied to the film.

It is very important to note that the electrostatic latent image created is in the exposed areas. Charge is captured by the light struck areas and is dissipated by dark decay from the non-illuminated areas. The rate of this dark decay can be increased by the selective application of softening means, such as heat or vapor, e.g. Freon 113, a fluorinated hydrocarbon available from DuPont, as well as other means which cause charge injection similar to that achieved by softening.

Although the imaging system of the instant invention is shown in FIGS. 2*a*, 2*b* and 2*c* in use with a conventional migration imaging member, variations in the structure of the imaging member can be used, including those which do not necessarily provide for preferred migration imaging.

Figure 3A:
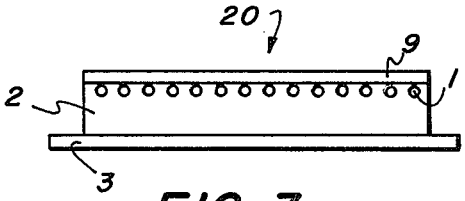
FIGS. 3*a*, 3*b*, 4 and 5 are partially schematic views of other imaging members suitable for use with the system of the invention.
Figure 3B:
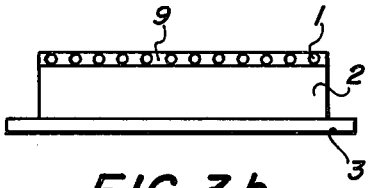

In FIGS. 3*a* and 3*b*, imaging member 20 employs a special overlayer 9 which is used to promote controlled charge injection. For example, the overlayer may allow more rapid charge injection at room temperature; or, no injection at all at room temperature. For example, if layer 9 was Pentalyn, a pentaerythritol ester of rosin, available from Hercules, Inc. injection would be suppressed at room temperature and the charged member would hold the charge until ready to produce the electrostatic latent image by heating after imagewise light exposure. Alternatively, the overlayer may be a photoconductor which has a different spectral response than that of the electrically photosensitive layer 1. In that case, a blanket exposure of light would be used to promote rapid charge injection.

Figure 4:
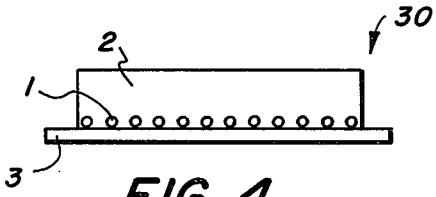
Figure 5:
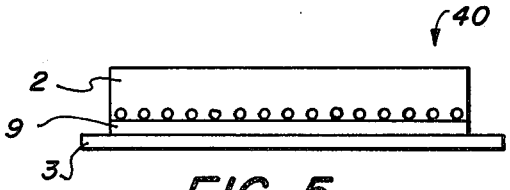

Imaging members 30 and 40 as depicted in FIGS. 4 and 5 show variations on this structure.

Although the basic process steps are described as being performed sequentially, it is possible that they be carried out simultaneously or nearly so. For example, exposure can be carried out simultaneously with charging so that, if charge injection occurs rapidly after charging, the photoconductor layer will be activated immediately to capture charge. Alternatively, the steps of exposure and processing to promote charge injection can be carried out simultaneously.

The use of flash heating with non-actinic light or radiant heating from the rear of an opaque base such as aluminized Mylar could be used for rapidly carrying out the third process step to quickly produce an electrostatic image. Alternatively, simultaneous uniform heating during imagewise exposure could be used.

Furthermore, in the preferred mode with discrete non-touching electrically photosensitive particles, it is possible that the process steps shown in FIGS. 2*a*, 2*b* and 2*c*, be carried out repeatedly to form additional electrostatic images on new portions of the same imaging member, or on new imaging members while the previously processed portions are in ambient light. This is possible because the previously formed electrostatic images are not affected by light.

It should be noted that while layer 2 should preferably be substantially electrically insulating for the preferred modes hereof, more conductive materials may be used provided that upon capturing charge the material does not neutralize the captured charge, by being excessively conductive, before development of the electrostatic image is completed.

The insulating material of layer 2 may comprise any suitable insulating material as defined above. Typical suitable insulating materials include polystyrene, alkyd substituted polystyrenes, polyolefins, styrene acrylate copolymers, styreneolefin copolymers, silicone resins, phenolic resins, and organic amorphous glasses. Other typical materials are Staybelite Ester 10, a partially hydrogenated rosin ester, Foral Ester, a hydrogenated rosin triester, and Neolyne 23, an alkyd resin, all from Hercules Powder Co., SR 82, SR 84, silicone resins, both obtained from General Electric Corporation; Sucrose Benzoate, Eastman Chemical; Velsicol X-37, a polystyrene-olefin copolymer from Velsicol Chemical Corp.; Hydrogenated Piccopale 100, a highly branched polyolefin HP-100, hydrogenated Piccopale 100, Piccotex 100, a copolymer of methyl styrene and vinyl toluene, Piccolastic A-75, 100 and 125, all polystyrenes. Piccodiene 2215, a polystyrene-olefin copolymer, all from Pennsylvania Industrial Chemical Co., Araldite 6060 and 6071, epoxy resins of Ciba; Amoco 18, a polyalpha-methylstyrene from Amoco Chemical Corp.; ET-693, and Amberol ST, phenol-formaldehyde resins, ethyl cellulose, and Dow C4, a methylphenylsilicone, all from Dow Chemical; M-140, a custom synthesized styrene-co-n-butylmethacrylate, R5061 A, a phenylmethyl silicone resin, from Dow Corning; Epon 1001, a bisphenol A-epichlohydrin epoxy resin, from Shell Chemical Corp.; and PS-2, PS-3, both polystyrenes, and ET-693, a phenol-formaldehyde resin, from Dow Chemical; and a styrene and hexylmethacrylate having an intrinsic viscosity of 0.179 dl/gm.

In many instances of layer configuration migration imaging the exposed film especially for preferred, low exposures, does not display the voltage contrasts normally associated with standard xerographic development. In these instances, charge associated with the electrophotographic imaging member hereof is thought to be largely due to polarized particles. Processing under the system of the instant invention converts the largely polarized charge latent image into an electrostatic latent image by reason of the charges on the imaging member other than those in the imagewise exposed areas being dissipated. There is then, a more typical electrostatic image in terms of showing definite electrostatic contrast which can be developed by xerographic techniques. Thus, a latent electrical image is converted into an electrostatic developable xerographic-type electrostatic image.

Figure 6A:
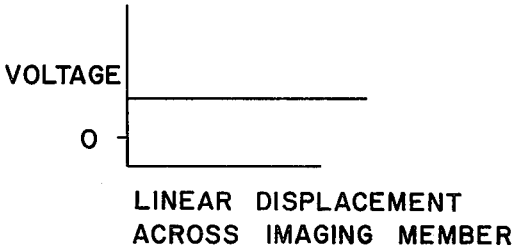
FIGS. 6*a* and 6*b* are graphs showing the relative surface voltage contrasts on a conventional migration imaging member after being exposed to a preferred, low exposure and the same imaging member processed according to the instant invention, respectively, after exposure, measurements being made by a feedback electrostatic voltmeter, Model 107AS-2, available from Monroe Electronics, Inc. of Middleport, New York.
Figure 6B:
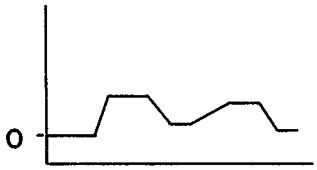

FIG. 6*a* shows a graph of the voltage variation on the surface of a latent image migration imaging member. Note that the voltage reading across the linear surface of the member does not vary, but rather stays substantially at the original potential. On the other hand, FIG. 6*b* shows the voltage variation, or contrast, on the surface of the same imaging member processed according to the instant invention. There is an obvious voltage contrast along the linear surface thereof.

The instant invention contemplates that two things happen to the charges during the process: (1) departure of the charge from the dark areas, and (2) acquisition of charge by the imaging member hereof in imagewise exposed areas. The method by which the charges go through the member is thought to occur in two steps: (1) the charge from the surface is injected into the structure and (2) the charges move through the whole structure. When the charges are transported through the whole structure the voltage in that area drops.

It should be understood that the preferred structures of imaging members useful with the herein disclosed invention are not necessarily those which are preferred in conventional migration imaging techniques. For example, this concept would include the use of (1) insulating materials which would not be preferred for migration imaging, insulating materials which are not necessarily readily softenable at reasonable temperatures or with reasonable solvents for migration imaging, and (2) photoconductive layers that are not acceptable for migration imaging, layers which may or may not be particulate or may or may not be fracturable. Furthermore, there may be combinations of materials, charge, softening means (heat or vapor), particles and voltage which are not preferred for migration imaging, but are preferred for the novel system herein described. An analogy can be made between the concepts in this invention and a screen which is porous, yet absorbent imagewise, like a sponge. If an attempt is made to pour water through the screen, where it is porous the water goes right through and where it is absorbent it is taken into the structure. The screen plays a role in controlling or modulating the way in which the charge goes through the member. In fact, the charges which would ordinarily hit the screen, deflect or move off the screen and pass through. This process will occur over a time period at room temperature; however, a gentle heating will reduce the amount of time necessary to capture the charge.

The high resolution capabilities of this imaging process make it especially well adapted for microimaging and data storage and retrieval systems. The insensitivity of the electrostatic image to light in preferred embodiments hereof also makes possible rapid non-destructive readout of an optical image generated by the electrostatic image. Furthermore, the process is valuable in systems where an external field is necessary for the maintenance of an optical image, as, for example, electric field fluid deformation wherein the image disappears as soon as the field is removed.

The erasable characteristics promoted by the instant invention provide a great deal of versatility in use of the imaging member. Thus, selective correction and reusability are distinctive qualities which add to the usefulness of the system. Single or cyclic erasure of the latent image can be accomplished by neutralizing and heating the previously charged areas. Obviously, it is desirous in this invention to prevent migration, therefore, it is best that the charging and heating be kept to a minimum. For example, under ordinary circumstances, a positive charge in the range from about 30 to 80 volts, at from about 70°C to 110°C for approximately 10 seconds will be sufficient to erase the latent image, without causing migration.

The following examples further specifically define the present inventive imaging system. While it is apparent that the majority of the following examples call for the use of the preferred particulate electrically photosensitive layer, it should be noted that a "Swiss cheese" type layer, made by a process such as disclosed in U.S. Pat. No. 3,598,644 using an insulating layer material with a viscosity of about $10^8$ or $10^9$ poises, as well as other electrically porous layers, e.g., relatively continuous layers with multiple cracks therethrough and semi-continuous layers made up of particles held together in dumbell fashion or by randomly located threads, may also be used in the process of the Examples. All voltage measurements set forth herein were made with a feedback electrostatic voltmeter as described above.

EXAMPLE I

A layered configuration imaging member is made by forming an about 2 micron thick insulating layer of a custom synthesized copolymer of polystyrene and hexylmethacrylate of a molecular weight of about 45,000 weight average on about a 3 mil thick substrate of Mylar polyester film from DuPont overcoated with a thin aluminum layer which is about 50 percent visible light transmissive. The photosensitive layer contiguous the free surface of the copolymer is about ¼ micron layer of about ¼ micron selenium particles which do not touch each other formed as disclosed in U.S. Pat. No. 3,598,644.

The member is uniformly negatively charged to a surface potential of about 100 volts and exposed for 3 seconds to a negative resolution target through a microscope illuminator placed 2 feet away, exposure in the illuminated areas being equivalent to about 10 ergs/cm$^2$ at 400 nanometers.

The thus exposed imaging member is then put into dark storage for a period of 2 days.

One-half of the member is then placed in white room light and then developed by conventional positive electrophoretic developer comprising carbon black suspended in Isopar H, a high purity isoparaffinic material available from Humble Oil and Refining Co.

The above exposure to room light after 2 days with no apparent loss of quality of the developed image indicates the durability of the electrostatic latent image in relation to light.

The remaining one-half of the member is left in dark storage for an additional 2 days.

This remaining half is then placed in white room light and then developed by conventional electrophoretic developer comprising carbon black suspended in Isopar H.

The above exposure to room light after 4 days with no apparent loss of quality of the developed image indicates the durability of the electrostatic latent image in relation to time and light.

It is observed in both cases that the developer adheres to the relatively exposed areas of the imaging member and that the resolution is in excess of 200 line pairs per millimeter.

EXAMPLE II

Example I is followed except powder cloud development with a positive toner is used and the developed image transferred to a paper receiving sheet.

It is observed that the toner adheres to the relatively exposed areas of the imaging member.

EXAMPLE III

Example II is followed with a repeat of the powder cloud development and image transfer steps. These steps are repeated a total of four times.

Each of the copies is observed to be of high quality and resolution.

EXAMPLE IV

The imaging member of Example I is negatively charged to a surface potential of about 100 volts and exposed to a negative transparency image with the exposure in the illuminated areas being about 10 ergs/cm$^2$ at 400 nanometers.

The member is stored in the dark for about ½ minute and cascade developed in the dark with a positive toner on a carrier.

It is noted that the toner deposits on the exposed areas.

The image thus created is of high quality and resolution.

EXAMPLE V

Example IV is followed, except that development is made in white room light.

The developed image is of high quality and resolution, comparable to that of the image produced in Example IV.

EXAMPLE VI

Example V is followed, except that instead of dark storage, the member is heated in the dark for about 2 seconds at about 70°C.

Again, it is noted that toner deposits in the exposed areas and the developed image is of high quality and resolution, comparable to that of the image produced in Example V.

EXAMPLES VII–XII

Example I is followed except that the photosensitive layer comprises, respectively, in these examples:

cadmium sulfide
phthalocyanine
arsenic triselenide
arsenic trisulfide
cadmium selenide
lead sulfide

EXAMPLE XIII

The imaging member of Example I is positively charged to a field strength of about 35 volts/micron and exposed to a light image with the exposure in the illuminated areas being about 10 ergs/cm$^2$ at 400 nanometers to form a negative charge electrical latent image.

The electrically latent imaged member is then exposed to trichlorotrifluoroethan vapor, the liquid available as Freon 113 from DuPont, for about 10 seconds.

The member is then cascade developed with a negative toner on a carrier.

It is noted that the toner deposits on the exposed areas.

The image thus created is of high quality and resolution.

EXAMPLE XIV

The first three paragraphs of Example I are followed by a positive charge of about 30 volts maximum and heating at about 70°C for about 10 seconds.

A voltage contrast reading is taken across the surface of the member. The results show a contrast of approximately zero volts, thereby indicating that the original electrical latent image has been erased.

EXAMPLE XV

Example XIV is followed with the charging, exposing, storage and developing steps of Example I.

The completeness of erasure of the original electrical latent image is further confirmed by the high quality and resolution of the second image.

EXAMPLE XVI

Example I is followed, except the dark storage period is extended to 2 years.

Upon development, it is observed that the quality and resolution have not deterioriated significantly.

EXAMPLE XVII

Example XVI is followed with the erasure steps of Example XIV.

Again, it is observed that the voltage contrast is approximately zero volts.

EXAMPLE XVIII

Example XVII is followed with the charging, exposing, storage and developing steps of Example I.

The completeness of erasure of the original electrical latent image is further confirmed by the high resolution and quality of the second image.

Although specific components, proportions and process steps have been stated in the above description of preferred embodiments of the imaging system, other suitable materials, proportions and process steps, as listed herein, may be used with satisfactory results and varying degrees of quality. In addition, other materials which exist presently or may be discovered may be added to materials used herein to synergize, enhance or otherwise modify their properties.

Additionally, many of the specific examples set forth herein call for the transfer of the toned image to a receiver sheet. It is also useful, at times, to eliminate the transfer step and fuse the toner directly to the imaging member. This fusing step may be accomplished by any standard fusing technique known in the xerographic arts.

Furthermore, it is possible to produce images of exceptionally high density and resolution by removing the visual effect of the selenium portions by transparentizing the selenium.

It should also be noted that the imaging member can be exposed from the bottom, if the substrate is sufficiently transparent to allow radiation to pass therethrough.

It will be understood that various changes in the details, materials, steps and arrangement of parts which have herein been described and illustrated in order to explain the nature of the invention, will occur to, and may be made by those skilled in the art upon the reading of the disclosure within the principles and scope of the invention.

What is claimed is:

1. An imaging method comprising the steps of:

a. providing an imaging member comprising a nonmigrating electrically porous layer of electrically photosensitive material contacting an insulating layer;
b. charging said imaging layer;
c. imagewise exposing said member to activating radiation for said electrically porous layer;
d. promoting the dissipation of charge in the nonexposed areas relative to the imagewise exposed areas and the capture of charge in the exposed areas, whereby an electrostatic latent image with higher surface potential in imagewise exposed areas is created; and e. using said electrostatic latent image to form a visible image.

2. The method of claim 1 wherein the charging of step (b) is negative.

3. The method of claim 2 wherein the image forming step of part (e) includes the application of toner.

4. The method of claim 1 wherein the promoting of dissipation of charge of step (d) comprises dark storage of the imagewise exposed imaging member for at least seconds.

5. The method of claim 1 wherein the promoting of dissipation of charge of step (d) comprises gently heating said imaging member to a degree insufficient to cause migration.

6. The method of claim 3 wherein the promoting of dissipation of charge of step (d) comprises gently heating said imaging member to a degree insufficient to cause migration.

7. The method of claim 2 further comprising the step of:

erasing said electrostatic latent image by subjecting said imaging member to a uniform positive charge and heating.

8. The method of claim 1 wherein the charging of step (b) is positive and the promoting of dissipation of charge of step (d) comprises the application of vapor to the imaging member.

9. The method of claim 1 wherein the image forming step of part (e) includes the application of toner and the further step of:

removing the photosensitive layer by transparentization.

10. The imaging method of claim 1 wherein said electrically porous layer of electrically photosensitive material is comprised of discrete, non-touching particles.

11. The method of claim 1 wherein the promoting of dissipation of charge of step (d) comprises softening to a degree insufficient to cause migration.

* * * * *